United States Patent [19]

Tsuda

[11] Patent Number: 4,937,587

[45] Date of Patent: Jun. 26, 1990

[54] LOW PROFILE SCANNING ANTENNA

[75] Inventor: George I. Tsuda, Fullerton, Calif.

[73] Assignee: Hughes Aircraft Company, Los Angeles, Calif.

[21] Appl. No.: 562,492

[22] Filed: Dec. 16, 1983

[51] Int. Cl.[5] ..... H01Q 3/08

[52] U.S. Cl. ..... 343/765; 343/766

[58] Field of Search ..... 343/761, 765, 766

[56] References Cited

U.S. PATENT DOCUMENTS

| | | | |
|---|---|---|---|
| 2,512,636 | 6/1950 | Flynt | 343/765 |
| 2,976,533 | 3/1961 | Salisbury | 343/761 |
| 3,202,015 | 8/1965 | Moul, Jr. et al. | 74/665 |
| 3,273,156 | 9/1966 | Doundoulakis | 343/765 |
| 3,351,946 | 11/1967 | Verge | 343/705 |
| 3,383,081 | 5/1968 | Guttenberg | 248/346 |
| 3,860,930 | 1/1975 | Peterson | 343/705 |
| 4,238,802 | 12/1980 | Speicher | 343/765 |
| 4,282,529 | 8/1981 | Speicher | 343/765 |
| 4,392,140 | 7/1983 | Bastian et al. | 343/765 |

FOREIGN PATENT DOCUMENTS

| | | |
|---|---|---|
| 826595 | 6/1975 | Belgium . |
| 2471058 | 6/1981 | France . |

*Primary Examiner*—Michael C. Wimer

*Attorney, Agent, or Firm*—Wanda K. Denson-Low

[57] ABSTRACT

A low profile, mechanical scan antenna having an aperture assembly and a travel guide assembly is disclosed. The aperture assembly is mounted on a carriage for movement along the travel guide assembly which is rotatably mounted for rotation about an azimuth axis. The travel guide assembly includes an arcuately shaped track and the aperture assembly and carriage move along the inside of the arcuately shaped track through the scanning angle. The arcuately shaped track defines an effective antenna gimbal axis which is in front of the antenna aperture.

18 Claims, 3 Drawing Sheets

LOW PROFILE SCANNING ANTENNA

BACKGROUND OF THE INVENTION

The invention generally relates to scan antennas and is specifically directed to a low profile scan antenna mounting system which has an effective gimbal axis in front of the antenna aperture.

Antenna mounting systems typically utilize X-Y type pedestals having azimuth and elevation rotational axes. For example, such antenna pedestals include structures which utilize a yoke supported on a rotatable mount. More specifically, some supporting systems for antennas utilize an arcuate yoke mounted to rotate about a first gimbal axis which is perpendicular to a plane which passes through the yoke. An inner gimbal assembly is mounted in the yoke to rotate about a second gimbal axis which is orthogonal to the first gimbal axis. The antenna or similar device is mounted to the inner gimbal assembly. Examples of such support structures are shown in U.S. Pat. Nos. 2,654,031; 3,351,946; 3,383,081; 4,238,802; and 4,282,529.

Other antenna mounting structures utilize relatively complex arrangements to reduce the swept volume of the antenna for operation in a limited amount of space, such as in an aircraft. For example, U.S. Pat. No. 3,860,930 discloses an antenna scan apparatus for use in an aircraft nosecone which includes an epicyclic gear train to rotate the antenna in a swept volume which is generally triangular. As another example, U.S. Pat. No. 4,225,868 discloses an X-Y antenna pedestal which utilizes multi-hinge points to achieve a lower profile.

Typical aircraft antenna mounting structures such as the above are either complex or bulky or both, and have required relatively large radomes and fuselage openings to accommodate wide angle scanning. The above described antenna characteristics have resulted in problems when applying the antennas to use in modern aircraft. Considerations such as the aerodynamic requirements, space limitations, and operational environment requirements of modern aircraft require radome structures which follow the contour of the aircraft, which have minimum fuselage openings for the antenna aperture, and require a compact or low profile antenna structure. Such requirements also impose problems concerning the scan angles that can be achieved with prior types of antenna mounts. For example, a typical X-Y antenna pedestal having a gimbal axis which is below or behind the radiating aperture requires an opening for the antenna aperture which is considerably larger than the antenna reflector size to achieve an antenna scan over a 140 degree cone.

In addition to the above described antenna types, there are electrical scan antennas including phased array systems. However, such systems occupy a substantial volume due to bulky integral equipment such as power dividers, phase shifters, waveguide "plumbing", amplifiers, control lines, etc. Also included are hybrid array scanning antenna systems, however these systems are also relatively large and complex and requires numerous mechanical components including lens elements.

SUMMARY OF THE INVENTION

It is a purpose of the invention to provide a low profile scan antenna system having a large scan angle which overcomes the above, and other, problems of prior techniques.

It is also a purpose of the invention to provide a low profile antenna having an effective gimbal axis located in front of the antenna radiating aperture.

Still another purpose of the invention is to provide a low profile antenna system which is simple and compact and requires minimum space in an aircraft application.

A further purpose of the invention is to provide a low profile antenna system usable in an airborne application which is adaptable to a flush mounted or conformal radome, and achieves a large scan angle with a minimum opening in the aircraft.

Yet another purpose of the invention is to provide a low profile antenna system which is usable in high frequency communications systems.

The foregoing and other purposes are accomplished by the invention wherein there is provided a low profile antenna system having an arcuate shaped guide assembly on which an antenna aperture is movably secured to travel on the inside of the arcuate path defined by the guide assembly thus establishing the effective gimbal axis forward of the antenna aperture. The guide assembly is rotatably mounted to rotate about an axis which is along a radius of the guide assembly. In one embodiment, a circular reflector with an associated feed is used as the antenna aperture. In another embodiment, an elliptical reflector is used, and this reflector results in increased gain over a circular reflector for the same size opening. Thus the scan angle of an antenna using an elliptical reflector can be increased for the same opening size without a decrease in gain since the increase in gain resulting from use of the elliptical reflector compensates for the blockage of the reflector surface at the extreme scan angles.

Other purposes, features and advantages of the invention will become apparent from a consideration of the accompanying drawings with the following detailed description of the invention.

DETAILED DESCRIPTION OF THE DISCLOSURE

Figure 1:
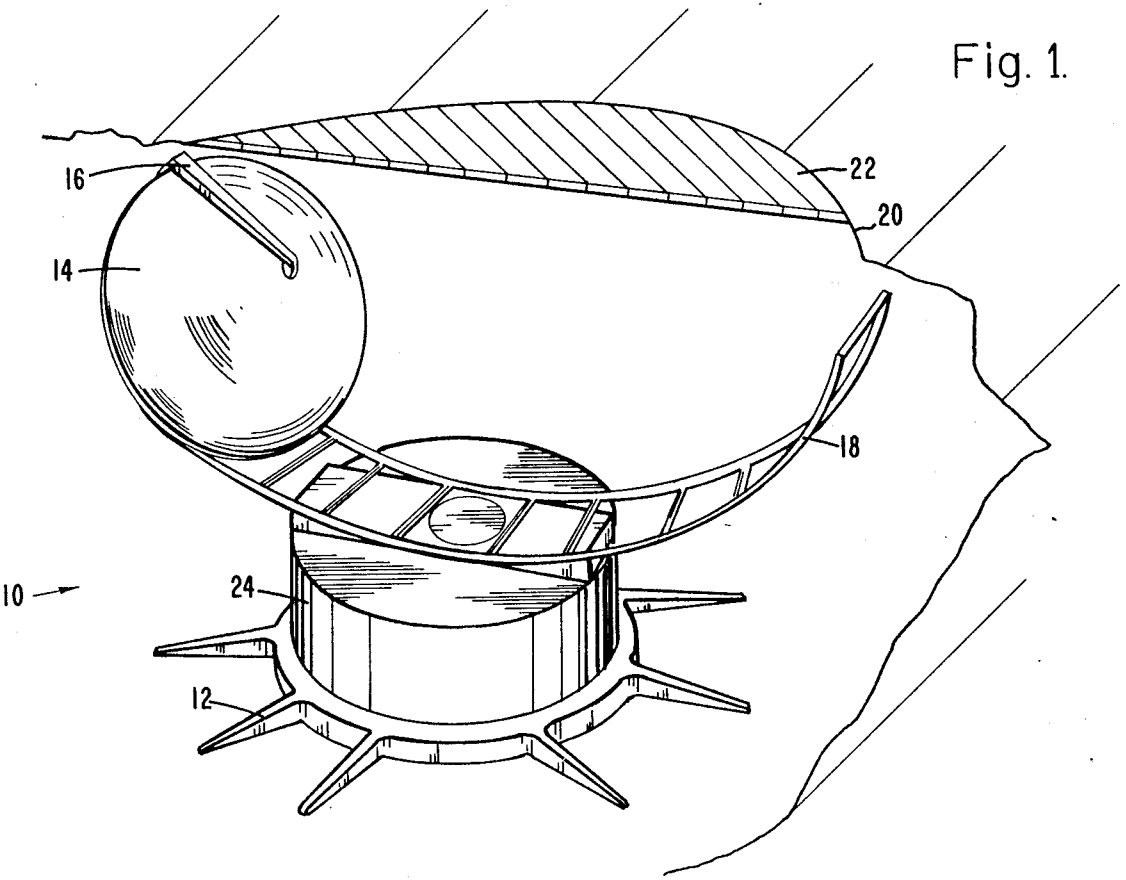
FIG. 1 is a perspective view illustrating a low profile scanning antenna in accordance with the invention.

In the following description like reference numerals will be used to refer to like elements in the different figures of the drawings. Referring now to FIG. 1, there is shown a low profile scanning antenna system in accordance with the invention. The disclosed scanning antenna system 10 includes a support base 12, a parabolic antenna reflector 14, an antenna feed 16 and a travel guide assembly 18.

The travel guide assembly 18 is rotatably mounted on the support base 12 which in turn is fixedly mounted to a frame or other like structure, such as an aircraft frame. Also partially shown in FIG. 1 is an opening 20 and a portion of a flush mounted or conformal dielectric covering 22 such as a radome. When the scan antenna system 10 is used in an application such as in an aircraft, the opening 20 and the radome 22 may be located in the top portion of the aircraft so that the beam pattern of the scan antenna system 10 is above the aircraft. A support bearing 24 is shown coupling the rotatable travel guide assembly 18 to the support base 12. A drive motor is located within the support bearing 24 for rotating the travel guide assembly 18.

Figure 2:
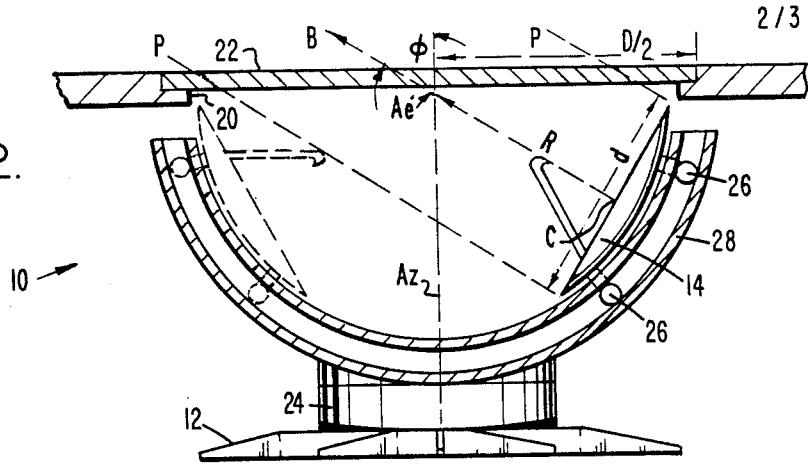
FIG. 2 is a schematic side view of a scan antenna in accordance with the invention.

Referring now to FIG. 2, the support bearing 24 mounted to the support base 12 is shown. The support bearing 24 allows the travel guide assembly to rotate about the axis Az, which is orthogonal to the opening 20 and the radome 22. In FIG. 2, the reflector 14 is shown mounted on a carriage assembly 26 which includes travel rollers and bearings. The carriage assembly 26 is appropriately adapted to travel along a track assembly which is generally illustrated and referred to with the reference numeral 28 and defines the arcuate path for antenna scanning. Two tracks are separated from each other by a selected length and between these two tracks, the rollers of the carriage assembly 26 travel. A drive apparatus (not shown) may be coupled to one or both rollers for movement of the carriage assembly 26 along the track 28.

Figure 4:
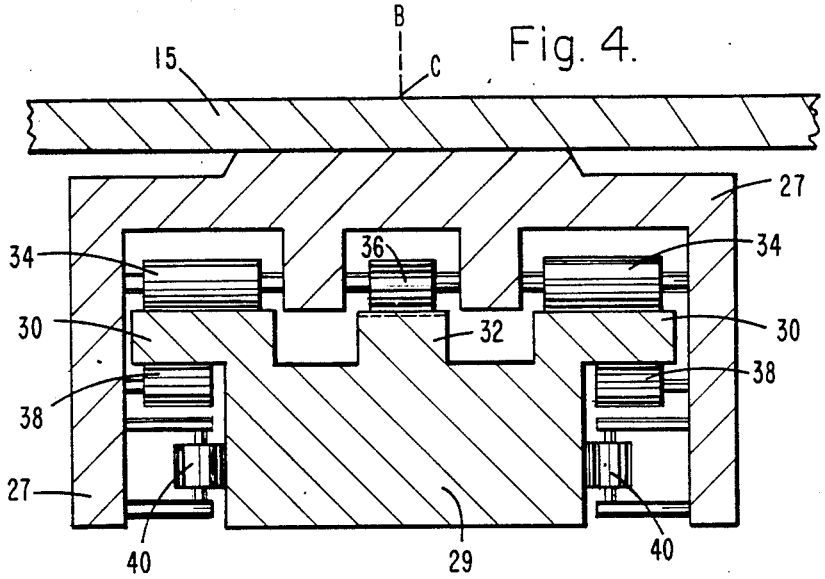
FIG. 4 is a partial sectional view showing a gear and roller assembly for utilizing the track shown in FIG. 3.
Figure 3:
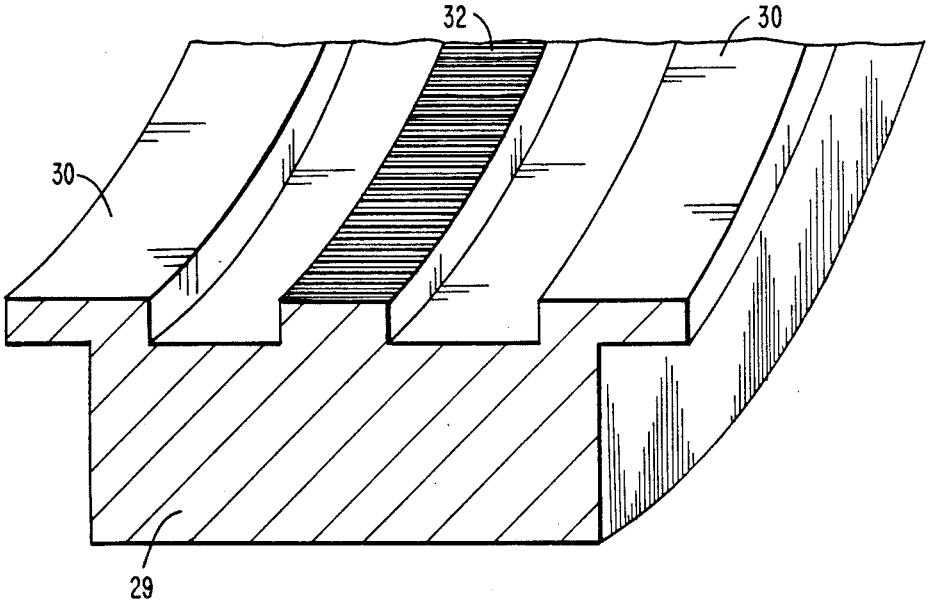
FIG. 3 is a sectional perspective view showing, by way of example, the track of a travel guide assembly usable in a scan antenna constructed in accordance with the invention.

Referring now to FIGS. 3 and 4, shown therein is an example of a track assembly 29 which may be used in the invention. FIG. 3 shows a cross-section view of a track 29 while FIG. 4 shows the same track 29 engaged with a carriage assembly 27. The track assembly 29 is arcuately shaped and includes outer rails 30 and an inner sector gear rail 32. The carriage assembly 27 includes rollers 34 which travel on the top of the side rails 30 and a pinion gear 36 which engages the sector gear rail 32. Rollers 38 travel along the bottom of the outer rails 30 and rollers 40 travel along the sides of the track 29. With this configuration of rollers, movement in any direction but along the track 29 is restrained. An appropriate driving mechanism, which may include a stepping motor mounted to the carriage assembly 27 and coupled to the pinion gear 36, rotates the pinion gear 36 to cause the carriage 27 to travel along the track 29 in the selected direction.

The track assembly 29 and the carriage assembly 27 are adapted so that the center C of the antenna aperture structure 15 (FIG. 4) travels in an arcuate path as the aperture structure 15 is moved from one terminal portion of the track 29 to the other terminal portion. For ease of reference, the center C of the aperture structure is the point on a plane defined by the periphery of the aperture structure and through which the boresight B emanates. While the arcuate path travelled by the center C of the reflector 14 (FIG. 2) may be of other arcuate shapes, in the disclosed example the arcuate path is an arc of a circle. The aperture structure in FIG. 4 is a phased array 15 while in FIG. 2, it is a reflector 14 with a circular periphery and having a feed 16.

As shown in FIG. 1, the reflector 14 has a circular periphery. Accordingly, FIG. 2 shows a diameter d of the reflector 14, which diameter is in the plane which includes the arc along which the reflector center C travels. FIG. 2 also shows the lines P which are projections parallel to the boresight B at the ends of the diameter d.

In FIG. 2, the scan angle $\phi$ of the reflector 14 is measured as the angle between the boresight B and the axis Az. For a given circular path travelled by the center C of the reflector 14, there will be an effective radius R between an effective elevation gimbal axis Ae and the center C of the reflector 14. For unobstructed projection of the lines P, the diameter D of the opening 20 and the effective radius R are determined by the maximum scan angle $\phi$ desired. Specifically, the effective radius R and the diameter D of the opening 20 are approximately calculated as follows for a given diameter d:

$$R=(d/2)\tan\phi \quad \text{(Eq. 1)}$$

$$D=d(1/\cos\phi) \quad \text{(Eq. 2)}$$

For example, for a maximum scan angle $\phi$ of sixty degrees (60°) relative to the axis Az, the radius R is about 0.866 d and the opening diameter D is equal to 2 d. Such opening would have an area of $\pi d^2$. As another example, for a maximum scan angle $\phi$ of seventy degrees (70°), the radius R is equal to 1.37 d, and the opening diameter D is equal to 2.92 d. Such opening would have an area of 2.13 $\pi d^2$.

The area of the opening 20 required for an antenna constructed in accordance with the invention is substantially less than the area of the opening required for a prior antenna system having a gimbal axis behind the antenna aperture. For example, for such a prior system to have a scan angle $\phi$ of sixty degrees (60°) relative to axis Az, the elevation axis gimbal must be spaced from the opening by a distance approximately equal to 5.8 d, where d is the diameter of a circular reflector. For that same maximum scan angle of sixty degrees (60°) the opening must have a diameter of at least 4 d and, therefore an area of 16 $\pi d^2$. That area for the prior system is sixteen (16) times the required area for the invention.

From the foregoing, it is apparent that for a given maximum scan angle, use of a prior scan antenna system having the gimbal axis behind the reflector requires a substantially larger opening than the invention to achieve an unobstructed view.

Figure 5:
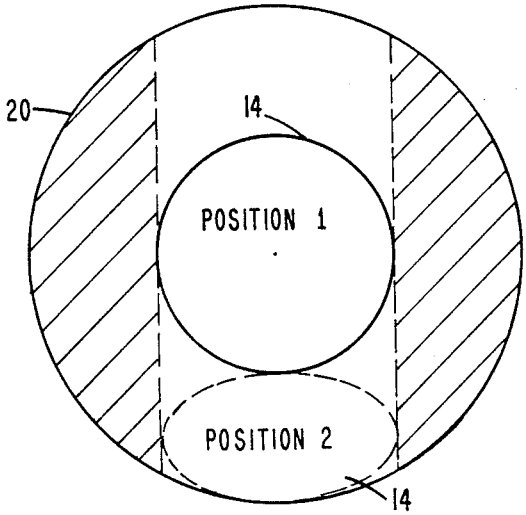
FIG. 5 is a diagram illustrating the coverage of a circular antenna reflector mounted in accordance with the invention and as viewed from outside an opening in an aircraft.

Referring now to FIG. 5, shown therein is an illustration of the circular reflector 14 as viewed from above the opening 20 of FIG. 1. Specifically, FIG. 5 illustrates the profile of the reflector 14 at two positions. POSITION 1 shows the reflector 14 as having its boresight in alignment with the axis Az, and POSITION 2 shows the reflector 14 profile when it is at the sixty degree (60°) scan position ($\phi$=60°). The shaded areas show the portions of the opening 20 which are not utilized when the reflector 14 is scanned at a fixed position to axis Az.

Figure 6:
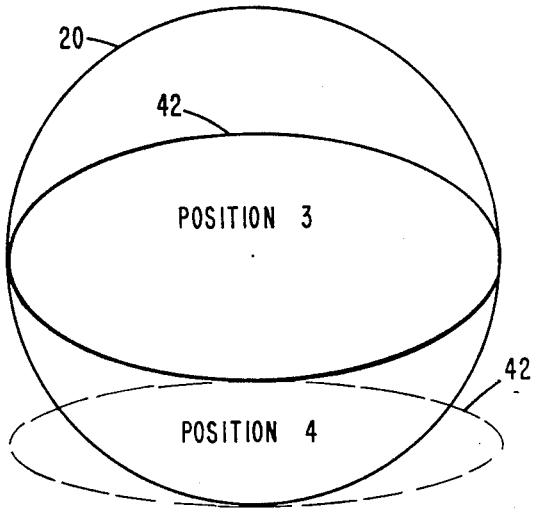
FIG. 6 is a diagram illustrating the coverage of an elliptical antenna reflector mounted in accordance with the invention and as viewed from outside an opening in an aircraft.

As discussed previously, other types of reflectors or antenna apertures are usable in the invention, e.g., an elliptical reflector and a phased array. An elliptical reflector is of particular importance however. FIG. 6 illustrates the use of an elliptical reflector 42 so that the opening 20 is more fully utilized Preferably, the elliptical reflector 42 has a minor axis of length x and a major axis of length 2 x. For example, x is equal to one foot and 2 x is equal to two feet. In FIG. 6, the major axis of the elliptical reflector 42 is shown as being equal to the diameter of the opening 20. The opening 20 and the effective gimbal radius R (see FIG. 2) are determined in the same manner as for the circular reflector 14 having a diameter d. POSITION 3 shows the elliptical reflector 42 with its boresight aligned with the axis Az, and POSITION 4 shows the reflector 42 in the sixty degree (60°) scanned position ($\phi=60°$).

It has been found that the increase in gain provided by the described elliptical reflector over a circularly shaped reflector is approximately 3 db. In view of that increase, another aspect of the invention is that an elliptical reflector, such as the elliptical reflector 42 shown in FIG. 6, can be used to provide the same amount of gain when scanned over a larger scan angle as the gain provided by the reflector scanned over a lesser scan angle. For example, it has been found that for a given size opening, an elliptical reflector scanned over an angle of seventy degrees (70°) provides the same amount of gain as a circular reflector scanned over an angle of sixty degrees (60°). This is accomplished by increasing the distance between the opening 20 and the travel guide assembly 18 to allow for clearance of the elliptical reflector 42 when it is at the maximum scan angle of seventy degrees (70°). Also, the travel guide 18 will have to be of sufficient length to allow the reflector 42 to travel the full seventy degrees (70°). As discussed above, it has been found that the gain of the elliptical reflector 42 at the maximum scan angle of seventy degrees (70°) with the blockage due to maintaining the same size opening, is approximately the same as the gain of the circular reflector 14 at the maximum scan angle of sixty degrees (60°). Thus by using an elliptical reflector, the scan angle can be increased with no loss in overall gain. Likewise, where a smaller antenna is required, an elliptical reflector may be used in a smaller antenna to achieve the same gain as a circular reflector of a larger antenna.

The disclosed low profile scan antenna system 10 achieves a large scan angle with a small opening requirement and requires a relatively small overall volume. The system is particularly useful in airborne applications as well as in other applications including land based use. Although the invention has been described in detail, it is anticipated that modifications and variations may occur to persons skilled in the art which do not depart from the scope of the invention. It is intended that the invention be limited only by the scope of the claims, not by the description, and so the invention will include such modifications and variations unless the claims limit the invention otherwise.

What is claimed is:

1. A low profile scanning antenna system comprising:
an antenna structure including a feed and reflector assembly;
a concave arcuate track;
mounting means for mounting the antenna structure on the arcuate track such that the antenna structure may be moved along the arcuate track; and
drive means for selectively moving the antenna structure along the concave arcuate track to achieve scanning;
whereby the antenna structure travels along a concave arcuate path defined by the concave arcuate track.

2. The low profile antenna system of claim 1 further comprising rotation means for selective rotation of the track.

3. The low profile antenna system of claim 1 wherein the feed and reflector assembly comprises a reflector having a circular periphery.

4. The low profile antenna system of claim 1 wherein the feed and reflector assembly comprises a reflector having an elliptical periphery.

5. The low profile antenna system of claim 4 wherein the elliptical periphery comprises a major axis and a minor axis, the major axis being twice the length of the minor axis.

6. The low profile antenna system of claim 1 wherein the concave track defines a preselected arc of a circle.

7. The low profile antenna system of claim 1 wherein the antenna structure comprises means for electronic beam scanning.

8. A scanning antenna system comprising:
an antenna structure including a feed and reflector assembly;
a concave arcuate track;
mounting means for mounting the antenna structure on the arcuate track such that the antenna structure may be moved along the arcuate track; and
drive means for selectively moving the antenna structure along the concave arcuate track to achieve scanning; and
means for selective rotation of the arcuate track about a rotation axis which is perpendicular to a tangent to the arcuate path;
whereby the antenna structure travels along a concave arcuate path defined by the concave arcuate track.

9. The antenna system of claim 8 wherein the feed and reflector assembly comprises a reflector having a circular periphery.

10. The antenna system of claim 8 wherein the feed and reflector assembly comprises a reflector having an elliptical periphery.

11. The antenna system of claim 10 wherein the elliptical periphery comprises a major axis and a minor axis, the major axis being twice the length of the minor axis.

12. The antenna system of claim 8 wherein the arcuate path defines a preselected arc of a circle.

13. The antenna system of claim 8 wherein the antenna structure comprises means for electronic beam scanning.

14. A low profile scanning antenna system comprising:
an antenna reflector;
feed means for feeding the reflector;
a concave arcuate track of a predetermined length;
mounting means for mounting the antenna reflector and feed means to the inside of the arcuate track so that the antenna reflector and feed means are movable along the arcuate track;
drive means for selectively moving the antenna reflector and feed means along the arcuate track so that the reflector and feed means travel along an arcuate path to achieve scanning; and
whereby the reflector and feed means travel along an arcuate path defined by the concave arcuate track.

15. The low profile antenna system of claim 14 wherein the antenna reflector comprises a reflector having a circular periphery.

16. The low profile antenna system of claim 14 wherein the antenna reflector comprises a reflector having an elliptical periphery.

17. The low profile antenna system of claim 16 wherein the elliptical periphery comprises a major axis and a minor axis, the major axis being twice the length of the minor axis.

18. The low profile antenna system of claim 14 wherein the arcuate track defines a preselected arc of a circle.

* * * * *